US005713518A

United States Patent [19]

Fox et al.

[11] Patent Number: 5,713,518

[45] Date of Patent: Feb. 3, 1998

[54] RAILROAD CROSS TIE AND TRACK CONTINUITY DETECTOR SYSTEMS

[76] Inventors: James C. Fox, 4431 Rexford, Holt, Mich. 48842; James C. Fox, II, 423 Meadowview, St. Johns, Mich. 48879

[21] Appl. No.: 690,830

[22] Filed: Aug. 1, 1996

[51] Int. Cl.[6] ..... E01B 3/00

[52] U.S. Cl. ..... 238/84; 238/85; 238/86; 238/91; 238/310; 246/121

[58] Field of Search ..... 238/83, 84, 85, 238/86, 91, 92, 95, 99, 102, 310; 246/120, 121

[56] References Cited

U.S. PATENT DOCUMENTS

| | | | |
|---|---|---|---|
| 377,162 | 1/1888 | Kelton | 238/84 |
| 683,734 | 10/1901 | Dunnell | 238/84 |
| 792,134 | 6/1905 | Israel | 238/86 |
| 950,327 | 2/1910 | Highbarger | 238/83 |
| 2,556,622 | 6/1951 | Koch | 238/85 |
| 2,611,545 | 9/1952 | Bartlett . | |
| 2,779,543 | 1/1957 | Gronlund | 238/86 |
| 3,416,727 | 12/1968 | Collins . | |
| 3,893,619 | 7/1975 | Bruner . | |
| 4,079,889 | 3/1978 | Halpenny . | |
| 4,083,491 | 4/1978 | Hill . | |
| 4,150,790 | 4/1979 | Potter . | |
| 4,416,419 | 11/1983 | Ohno . | |
| 5,055,350 | 10/1991 | Neefe . | |

*Primary Examiner*—S. Joseph Morano
*Attorney, Agent, or Firm*—John R. Benefiel

[57] ABSTRACT

A rail tie and track-tie connection includes a molded plastic body member having molded plastic cover pieces attached to the body member, with lip portions engaging and capturing bottom flanges on the track rails. The body member may be hollow with a filler mass supporting the sides and cross bolts providing further reinforcement. A detector circuit for electronically detecting removal of a cover piece is located within the tie body member.

10 Claims, 3 Drawing Sheets

RAILROAD CROSS TIE AND TRACK CONTINUITY DETECTOR SYSTEMS

BACKGROUND OF THE INVENTION

This invention concerns railroad track construction and more particularly cross ties and tie rail connections as well as detector systems for detecting when a break in a track rail has occurred.

Traditional railroad track construction has involved the use of treated timber ties laid in the ballast of the rail bed, to which the track rails are spiked, using headed spikes holding one edge of the rail bottom flange when the spike is fully driven into the tie. Splicer pieces at abutting rail ends are bolted to the center web of each adjacent rail end, or on certain lines the abutting rails are welded together.

The use of timber cross ties has several disadvantages, i.e., even treated timbers eventually rot and are subject to splitting and warpage after extended periods of exposure. The spikes tend to loosen and must be pounded in to be reset periodically. The rails are not positively held in position by use of the spikes.

These disadvantages contribute to high track maintenance costs.

Traditional track construction also results in a rigid structure contributing to noise and vibration transmitted to the rail cars.

Such a track is also vulnerable to acts of sabotage carried out by a person simply removing spikes and splicer pieces along the track.

While electronic track continuity test systems exist, these are easily defeated with jumper wires connected across the rail joints.

While it has heretofore been proposed to provide cross ties of plastic or composite material construction, a practical plastic tie has yet to be developed which effectively overcomes all of the problems mentioned above at a reasonable cost.

See for example U.S. Pat. No. 3,813,040 issued on May 28, 1974 for a "Plastic Railroad Tie"; U.S. Pat. No. 3,416,727 issued on Dec. 17, 1968 for a "Synthetic Plastic Railroad Tie"; U.S. Pat. No. 5,055,350 issued on Oct. 8, 1991 for a "Composite Railroad Cross-Tie"; U.S. Pat. No. 3,598,312 issued on Aug. 10, 1971 for a "Synthetic Crosstie"; U.S. Pat. No. 2,611,545 issued on Sep. 23, 1952 for a "Railroad Tie"; U.S. Pat. No. 3,893,619 issued on Jul. 8, 1975 for a "Crosstie for Railroad Track"; and, U.S. Pat. No. 4,083,491 issued on Apr. 11, 1978 for a "Synthetic Railroad Crosstie".

It is the object of the present invention to provide a plastic railroad cross tie and tie track connection which eliminates the problems arising from the use of timbers, and provides accurate and secure track tie connection which is resistant to tampering.

It is another object of the present invention to provide a track discontinuity detector system which is not easily defeated.

SUMMARY OF THE INVENTION

The above object and others which will be understood upon a reading of the following specification and claims are achieved by a cross tie constructed with a molded plastic elongated hollow cross tie body filled with ground rubber material such as recycled used tires, which is bonded together into a solid mass with a binder substance such as an epoxy resin. This construction dampens vibration and noise. Rail support reinforcing structures are positioned within the hollow tie body at appropriate spaced locations.

A series of molded plastic top pieces are fit over the tie body and fixed thereto with fasteners having antitamper heads. The top pieces include a projecting lip edge which extends over and engages respective flanges on a track rail to be securely held to the tie assembly.

Reinforcing tie cross bolts can extend across the tie body and through the opposite sides. The tie body may also be underlain with a hard rubber cushion to further cushion the rails.

The top pieces are preferably held to the tie body by horizontally extending antitamper fasteners extending through a sidewall of the top piece and through an adjacent sidewall of the tie body.

In an alternative embodiment, the cover pieces are secured with through bolts extending downwardly into a solid molded plastic tie.

At rail splice joints, the cover pieces have upwardly projecting flange portions which extend over the rail web and steel splice pieces, and are bolted to the splicer pieces and rail web.

A continuity electrical circuit may also be incorporated mounted within the interior of the hollow tie body which generates an electrical signal whenever a cover piece is removed, even if a jumper wire is installed at the rail joints.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
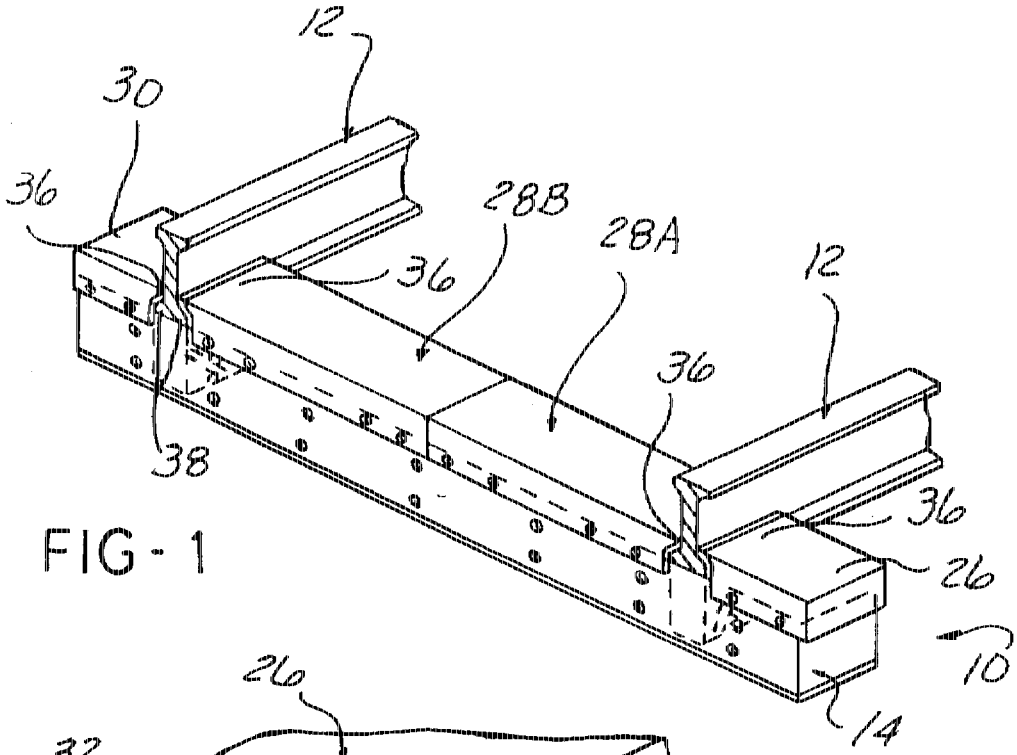
FIG. 1 is a perspective view of a tie according to the present invention with fragmentary perspective view of portions of track rails installed attached to the tie.
Figure 2:
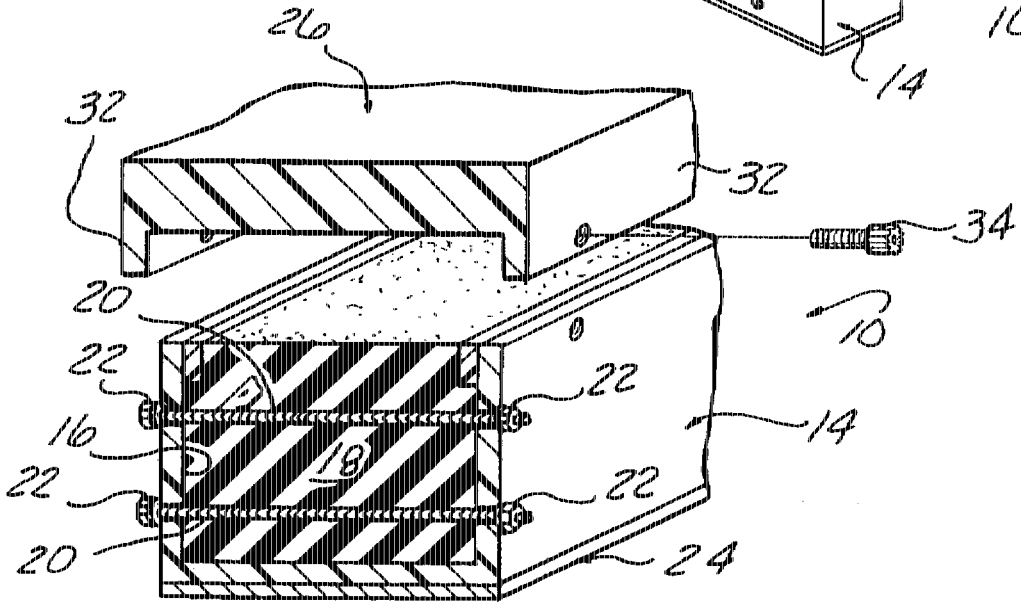
FIG. 2 is an exploded sectional fragmentary view of a portion of the tie according to the present invention.
Figure 3:
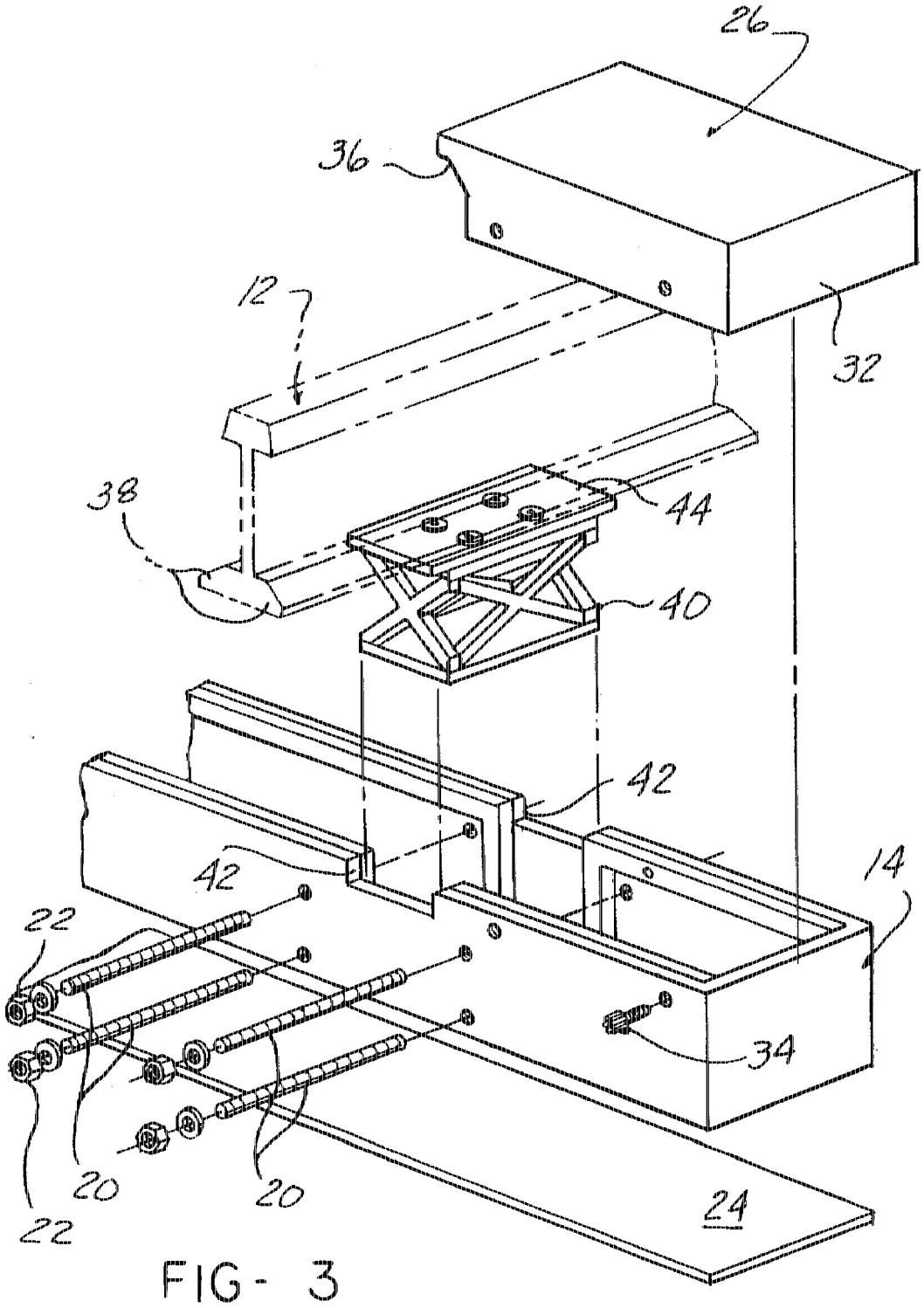
FIG. 3 is an exploded fragmentary perspective view of the railroad tie shown in FIGS. 1 and 2.

Referring to the drawings and particularly FIGS. 1–3, a railroad cross tie 10 according to the present invention is shown for supporting a pair of spaced apart track rails 12. It should be understood that the tie 10 would be partially buried in the ballast of the rail bed as in the case of conventional railroad ties in the manner known by those skilled in the art.

The railroad tie 10 includes an elongated tie body 14 of the same approximate length and width as conventional cross ties, which body 14 comprises a molded plastic open-topped box having an internal cavity 16. The cavity 16 is filled with a granular composite material, preferably ground reclaimed rubber as from used tires, with a suitable high strength binder such as epoxy resin setting the material into a solid mass.

Sets of reinforcing bolts 20 extend across the cavity 16 through either side of the body 14, and are molded into the composite filler mass 18 with bolts and nuts 22 on either end. A hard-rubber cushion layer 24 may also be provided, attached to the bottom wall of the body member 14 to further reduce noise and vibration. A series of generally flat top pieces 26, 28A, 28B, 30 are of a width to completely overlie the top of the tie body member 14. Cover pieces 26 and 30 fit into the space between a respective end of the tie body member 14 and the outside of a respective rail track 12, while the inner two top cover pieces 28A and 28B together fit into the space between the two track rails 12.

Each cover piece 26, 28A, 28B, 30 is provided with depending flanges 32 which fit alongside the respective sidewall of the tie body 14 and special head fasteners 34 are driven through the flanges 32 and into a thickened top edge of the tie body member 14 to secure the top pieces in position.

The special head fasteners 34 are of a known design which have a unique drive head which requires a special tool to remove such that tampering using conventional tools is prevented.

Each cover piece has a lip portion 36 extending substantially entirely across its width and configured to be complementary to one side of the corresponding bottom flange 38 on the track rails 12 such as to capture the rail flange 38 when the cover is secured in position atop the tie body member 14.

The special fasteners 34 extend horizontally and are loaded in shear by the up and down deflecting movement of the rail tracks 12 as a rail car or engine passes over each section, such as to eliminate any tendency for pulling the fasteners 34 loose after extended use.

As seen in FIG. 3, a rail support reinforcing structure 40 is installed within each tie body member 14 at a location whereat the track sections 12 are to be installed aligned with notched-out regions 42.

The structures may be of metal or a high strength plastic and provide additional support for the loading of the track rail.

A cushioning hard rubber pad 44 may be riveted to the top of each rail support insert structure 40 to further reduce noise and vibration.

The plastic used for molding of the tie body 14 and cover pieces would be suitable high strength weatherproof plastic such as PVC. The cross bolts 20 may also be of either plastic or metal.

Figure 4:
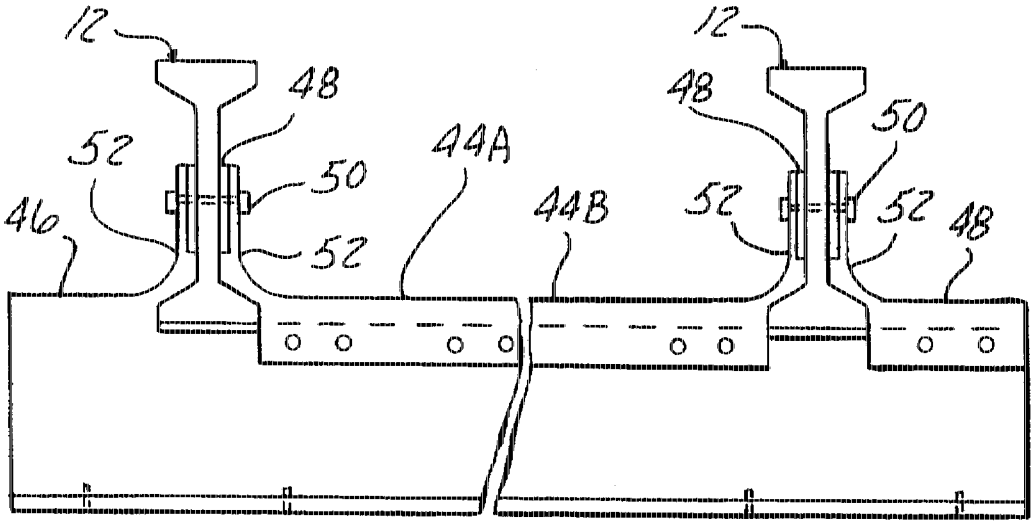
FIG. 4 is a front elevational view of a splicer version of the tie cover pieces with rails and splicer pieces installed thereon.
Figure 5:
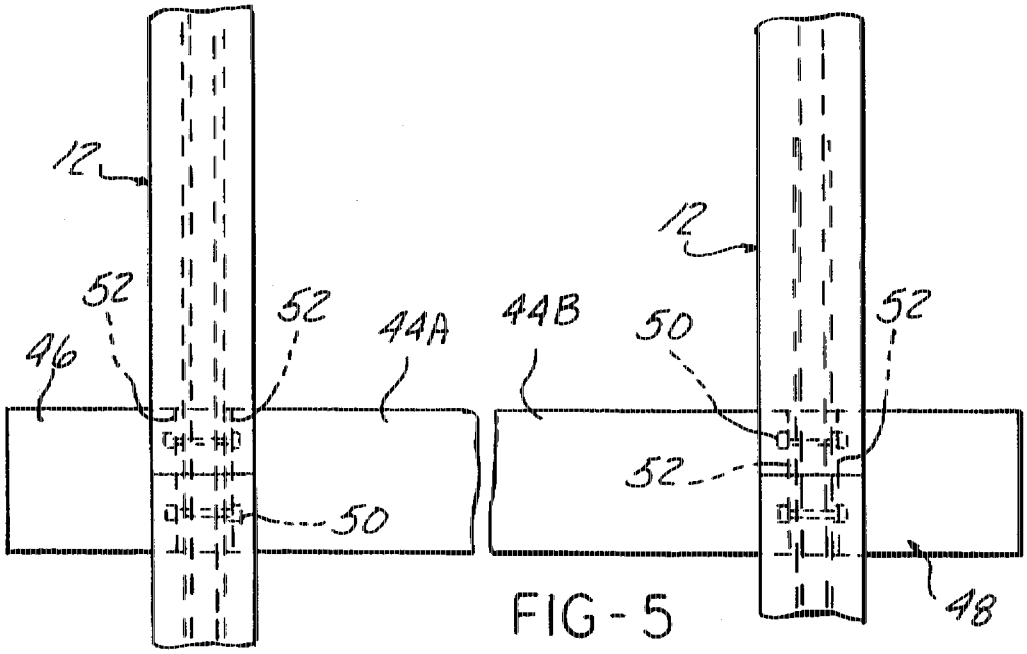
FIG. 5 is a fragmentary planned view of the rail track components shown in FIG. 4.

Referring to FIGS. 4 and 5, special cover pieces 44A and 44B may be employed at track joints as well as an integrally molded end cover 46. A conventional steel splicer piece 48 is secured with fasteners 50 extending through the center web of each track section at the adjacent ends. The cover pieces 44A, 44B, 48 have an integrally molded upwardly extending flange 52 which overlaps the splicer piece 48 and is secured with the fasteners 50.

Figure 6:
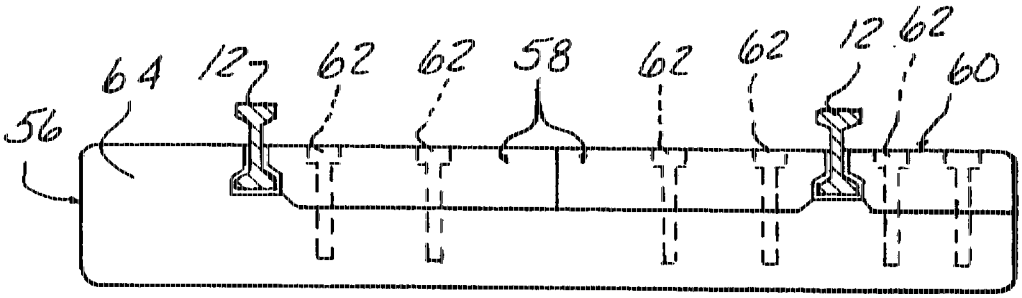
FIG. 6 is a front elevational view of an alternate form of the railroad tie according to the present invention with a sectional view of the respective track sections.

An alternative construction is shown in FIG. 6 in which a solid tie body 56 is employed, and relatively thick sturdy cover pieces 58 and 60 are secured thereto with vertically extending bolts 62 received in the solid tie body 56.

An integral end portion 64 is molded with the solid tie body 56.

Figure 7:
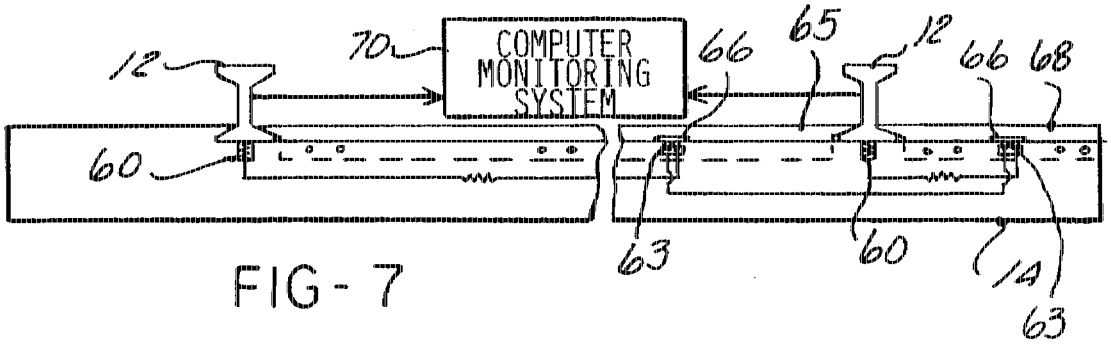
FIG. 7 is a schematic diagram of a track continuity detector circuit installed in a cross tie according to the present invention.

FIG. 7 depicts a continuity detector circuit mounted within tie body 14. A tamper circuit shown in FIG. 7 includes electrical contacts mounted within the tie body 14 contacting the underside of the flange of each respective track rail 12.

A pair of spring-loaded contacts 62 are also mounted beneath the cover piece 64 engaging a metal strip 66 to establish electrical contact. In the event the cover 64 or 68 is removed, the circuit is interrupted which is detected by a computer continuity monitoring system 70 which is currently used on most rail lines. This will not be defeated by attaching jumper wires across rail joints, and access to attempt to defeat the detector is prevented without removing the cover pieces.

We claim:

1. A railroad tie track connection for two spaced railroad tracks comprising:

an elongated molded plastic body member having a generally rectangular flat top;

a series of three generally flat cover pieces arranged along the length of said body member overlying and fixedly attached to the top of said body member, each cover piece having a width corresponding to the width of said top of said body member, a cover piece at each end of said body member including a protruding lip portion at one end thereof extending substantially completely across the width of said cover piece and extending over one side of a bottom flange of a respective track rail to capture said one side of said bottom flange, a center-located cover piece between said cover pieces at respective ends of said body member formed with a lip at each end extending substantially completely across the width thereof, each lip extending over another side of a bottom flange of each track rail to capture said another side of said bottom flange of each track rail, a pair of spaces formed between said one end of each of said cover pieces at each end of said body member and said ends of said center-located cover piece, each space having a track rail bottom flange disposed therein at a predetermined track rail spacing.

2. The railroad tie track connection according to claim 1 wherein said body member is hollow and filled with a mass of filler material to support sidewalls of said body member.

3. The railroad tie track connection according to claim 2 wherein said filler material comprises ground rubber particles bonded together to form a solid material.

4. The railroad tie track connection according to claim 2 further including a rail support insert located below each track rail bottom flange and providing support therefor.

5. The railroad tie track connection according to claim 2 further including detector circuit means including contacts on an inner surface of at least some of said cover pieces, and means for opening a circuit when one of said cover pieces is removed.

6. The railroad tie track connection according to claim 2 further including cross bolts extending through said body member to provide support therefor.

7. The railroad tie track connection according to claim 1 wherein each of said cover pieces has a depending flange overlying a side of said body member, and a series of fasteners extending through said flange and said body side.

8. The railroad tie track connection according to claim 7, wherein said fasteners have a head requiring a special tool for removal.

9. The railroad tie track connection according to claim 1 wherein said molded plastic body member is solid and said cover pieces are secured with vertically extending fasteners.

10. The railroad tie track connection according to claim 1 wherein said lip portions extend vertically and are positioned against a center web of a respective track rail, and is attached thereto with fasteners extending through said lip portion and said track rail web.

* * * * *